United States Patent [19]

Ward

[11] Patent Number: 4,705,168

[45] Date of Patent: Nov. 10, 1987

[54] DRAWER DIVIDER SYSTEM

[75] Inventor: William W. Ward, Clayton, N.C.

[73] Assignee: Southern Case, Inc., Raleigh, N.C.

[21] Appl. No.: 400,386

[22] Filed: Jul. 21, 1982

[51] Int. Cl.[4] ..... B65D 85/20

[52] U.S. Cl. ..... 206/373; 206/376; 220/22.2; 220/22.4

[58] Field of Search ..... 206/349, 372, 373, 374, 206/376, 379; 220/22.1, 22.2, 22.4, 22.6, 22.3

[56] References Cited

U.S. PATENT DOCUMENTS

| | | | |
|---|---|---|---|
| 417,640 | 12/1889 | Hirsch | 220/22.2 |
| 464,544 | 12/1891 | Wood . | |
| 943,719 | 12/1909 | Vick | 220/22 |
| 1,523,136 | 1/1925 | O'Connor . | |
| 1,945,231 | 1/1934 | Raabe . | |
| 1,995,335 | 3/1935 | Wilke | 220/22.3 |
| 2,541,597 | 2/1951 | Midling . | |
| 2,788,912 | 4/1957 | Simonsen . | |
| 2,940,200 | 6/1960 | Endlich . | |
| 2,944,696 | 7/1960 | Effgen . | |
| 3,200,983 | 8/1965 | Walter . | |
| 3,554,429 | 1/1971 | Cohen . | |
| 3,612,637 | 10/1971 | Betts . | |
| 3,702,136 | 11/1972 | Albertson . | |
| 3,746,181 | 7/1973 | Benoit . | |
| 3,837,477 | 9/1974 | Boudreau | 206/376 |
| 3,954,202 | 5/1976 | Petrick . | |
| 4,303,158 | 12/1981 | Perkins . | |
| 4,346,813 | 8/1982 | Cho et al. | 220/22 |

FOREIGN PATENT DOCUMENTS

| | | | |
|---|---|---|---|
| 2837683 | 3/1979 | Fed. Rep. of Germany . | |
| 0187882 | 11/1922 | United Kingdom . | |
| 0222340 | 10/1924 | United Kingdom | 220/22 |

*Primary Examiner*—Jimmy G. Foster

*Attorney, Agent, or Firm*—Bell, Seltzer, Park & Gibson

[57] ABSTRACT

Disclosed is a drawer divider system for dividing a drawer in a tool chest or the like into a plurality of compartments. The divider elements comprise one-piece plastic strips having integrally formed resilient arms at both ends for engaging the opposed sidewalls of the drawer. The divider is provided with a plurality of upwardly facing recesses in the form of inverted saw-teeth along its length so that the recesses of adjacently positioned dividers may support articles therein.

6 Claims, 6 Drawing Figures

DRAWER DIVIDER SYSTEM

BACKGROUND OF THE INVENTION

1. Field of the Invention

The present invention relates to the organization of the contents of drawers. The invention particularly relates to a drawer divider system including insertable, integrally formed drawer dividers for dividing a drawer into a plurality of compartments.

2. Description of the Prior Art

It is often desirable that drawers in storage chests, particularly in tool boxes, be capable of subdivision into a plurality of compartments for segregating various articles stored therein. Many systems have been devised for this purpose, including systems utilizing insertable elongate strips held in place between a pair of opposed sidewalls of the drawer. Most such systems of the prior art require multiple components for forming each drawer divider, or require specially formed elements in or adjacent the walls of the drawer to receive the dividers. To date, no commercially available drawer divider system overcomes the noted disadvantages of the prior art.

SUMMARY OF THE INVENTION

The present invention provides a novel and commercially attractive drawer divider system that can be economically manufactured and have a useful life of years.

Broadly, the drawer divider of the invention is formed as a thin elongate upstanding strip, preferably of plastic material, and integrally formed resilient arms at both ends of the strip for engaging the opposed sidewalls of a drawer.

In accordance with one aspect of the invention, there is provided a drawer divider system including a drawer having opposed sidewalls and at least one elongate drawer divider for dividing the drawer into a plurality of compartments. Each drawer divider comprises a main body portion comprising a relatively thin elongate strip member having a length approximating the distance between the opposed sidewalls of the drawer, with the body portion strip member being substantially vertically upstanding in its operational orientation, and at least one sidewall engaging portion integrally formed at an end of the body portion. The sidewall engaging portion comprises a pair of resilient arms integrally joined together at the body portion end and flaring outwardly from the body portion to sidewall engaging tips. The resiliency of the arms permits the arms to exert sufficient force at the points of engagemen with the sidewalls to securely hold the drawer divider therebetween.

The strip member may be provided with a plurality of upwardly facing recesses along the length thereof so that the recesses of adjacently positioned drawer dividers may support articles therein. Preferably, the recesses have an inverted sawtooth configuration.

The base of the strip member may be provided with a flange to prevent bowing of the divider along its length. The rigidity of the strip member may be further enhanced by including elongate beads formed at the junctures of the flanges and the main body portion.

The present invention offers numerous advantages over drawer divider systems of the prior art. For example, in accordance with the present invention, the elongate drawer divider elements have a simple, one-piece construction, preferably injection molded. Since the divider is in one piece and there are no special receiving compartments, or the like, on the drawer sidewall faces, there is no problem with small auxiliary components being lost or improperly assembled. The divider elements may be used for years and should have a useful life at least as great as that of the storage chest in conjunction with which it is used. These and many other advantages of the invention will become more apparent from the following detailed description.

BRIEF DESCRIPTION OF THE DRAWINGS

The invention will be more fully understood from the following detailed description thereof taken in connection with the accompanying drawings, in which.

DETAILED DESCRIPTION OF THE INVENTION

While the present invention will be described hereinafter with particular reference to the accompanying drawings, it is to be understood at the outset of the description which follows that it is contemplated that the present invention may be varied in specific detail while still achieving the desirable characteristics and features of the present invention. Accordingly; the description is to be understood as a broad enabling teaching directed to persons skilled in the applicable arts, and is not to be understood as restrictive.

Figure 1:
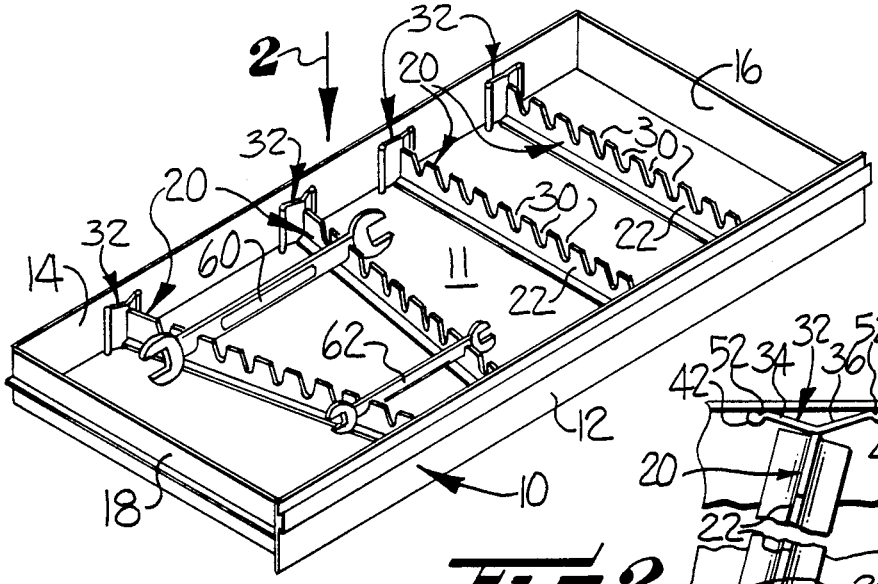
FIG. 1 is a perspective view of a drawer including four identical drawer dividers positioned therein, with the two dividers at the left of the drawer performing the auxiliary tool holding function.
Figure 2:
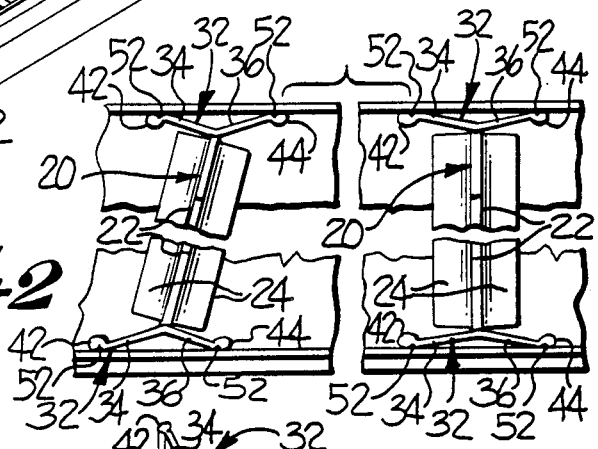
FIG. 2 is an enlarged top plan view of the two centermost dividers shown in FIG. 1, with portions of the drawer and dividers broken away to facilitate illustration.
Figure 3:
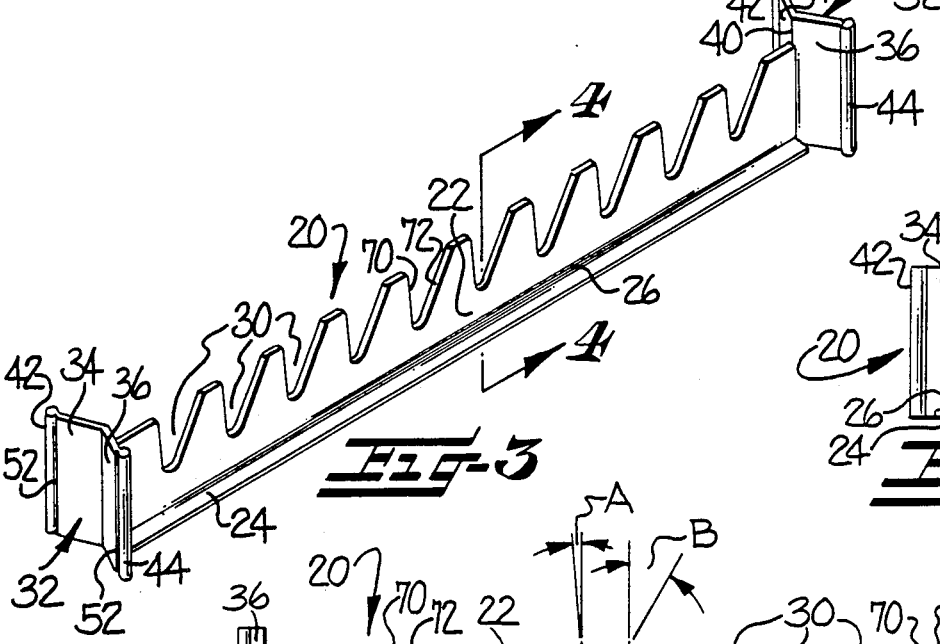
FIG. 3 is a perspective view of a drawer divider of the invention.

Referring to the drawings, and more particularly to FIGS. 1 and 2, there is shown a drawer divider system comprising a drawer 10 and four drawer dividers 20 subdividing the drawer into multiple compartments.

Drawer 10 includes a bottom wall 11 and two pairs of opposed sidewalls, pairs 12, 14 and 16, 18. Drawer dividers 20 engage sidewall pair 12, 14 and are insertable and removable therefrom in a manner to be described in more detail below.

Figure 4:
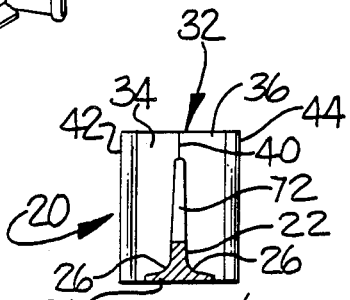
FIG. 4 is a sectional view of the drawer divider taken substantially along the line 4—4 in FIG. 3.

The details of the structure of drawer dividers 20 will now be described with reference to FIGS. 3–6. Divider 20 includes a main body portion 22 which takes the form of a relatively thin, elongate strip member having a length approximating the distance between the opposed sidewalls 12, 14. As shown, the strip member is substantially vertically upstanding in the operational orientation of the drawer divider. In order to provide lengthwise rigidity to prevent bowing of the main body portion 22, a flange 24 is provided at the base of the main body portion. As best shown in FIG. 4, the lengthwise rigidity is best achieved by providing a radius 26 where flange 24 joins body portion 22.

In the particular embodiment illustrated in the drawings, the main body portion is provided with a plurality of recesses in the form of inverted sawteeth 30, the structure and function of which will be described in more detail below.

Figure 6:
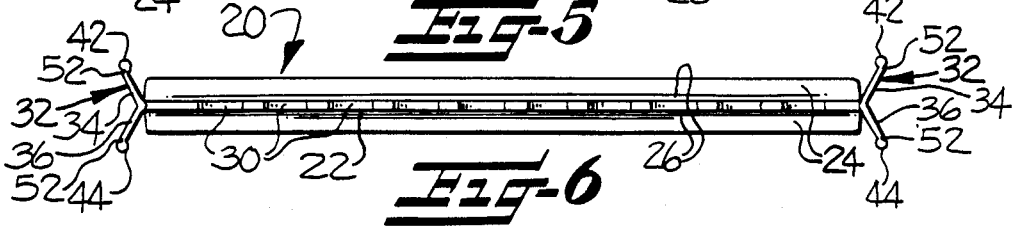
FIG. 6 is a top plan view of the drawer divider shown in FIGS. 3, 4 and 5.

In the preferred embodiment, each end of drawer divider 20 includes an integrally formed sidewall engaging portion 32 comprising a pair of outwardly flaring, resilient arms 34, 36 integrally joined together and integrally joined to a body portion end at a juncture line 40. As best shown in FIG. 6, the sidewall engaging portions are collectively V-shaped and terminate in tips 42, 44 for engaging the opposed drawer sidewalls in the manner shown in FIGS. 1 and 2. Arm tips 42, 44 are substantially vertically upstanding surfaces and, in the illustrated embodiment, each tip is formed with an enlarged substantially circular cross section and has an adjacent recess 52. As shown in FIG. 2, the circular cross section and recess 52 cooperate to facilitate the gripping action of the tips 42, 44 to the engaged sidewall.

While divider 20 has been described as having resilient arms at both ends thereof, it will be appreciated that the arms at one end may be formed so that they are not resilient or do not cooperate in creating the holding force for maintaining the divider in place.

Drawer divider 20 is preferably formed from thermoplastic material by injection molding, with a preferred plastic material being polypropylene. The plastics forming operation lends a resiliency or deformability to the arms 34, 36 of the sidewall engaging portions. As best shown in FIG. 2, the arms 34, 36 are adapted to deflect to increase the V-angle therebetween and to exert sufficient force at the points of engagement with the sidewalls to securely hold the dividers therebetween. The deformation at the sidewall engaging portions occurs along the length of the arms 34, 36 and also as a pivoting or hinging action at juncture 40.

When the dividers are inserted substantially perpendicular to the opposed sidewalls, as illustrated by the divider 20 shown in the right-hand portion of FIG. 2, the resiliency of the two pairs of arms 34, 36 allows the dividers to accommodate substantial tolerances in the drawer widths. Such variance in the distance between drawer sidewalls may be introduced in the manufacturing of the drawer or may exist due to deformation of the drawer from use.

In accordance with the particular embodiment of the invention illustrated in the drawings, a drawer divider 20 is provided for insertion into drawers having opposed sidewalls spaced by 10.750 inches. Excellent results have been achieved by forming the main body portion with a length of 10.250 inches, with the overall length of the divider, including arms 34, 36, being approximately 10.937 inches. This results in an overall linear deformation of 0.187 inches, when the divider is used with a nominally sized drawer. However, it has been found that the drawer divider will securely remain in position at substantially right angles to the opposed sidewalls with drawer widths in the range of approximately 10.625 inches to 10.925 inches. It will be understood, however, that with drawer widths somewhat less than 10.625 inches, the drawer divider may be secured in place by positioning it slightly off of the shown perpendicular alignment.

The auxiliary tool-holding function of the invention will now be described in detail, with reference initially to FIGS. 1 and 2. In some instances it is desirable to store elongate articles in a spaced, substantially parallel mode such as represented by wrenches 60, 62 in FIG. 1. In accordance with the present invention, this tool-holding function may be accomplished by placing the tool bodies in the inverted sawtooth configurations in two adjacent drawer dividers.

Figure 5:
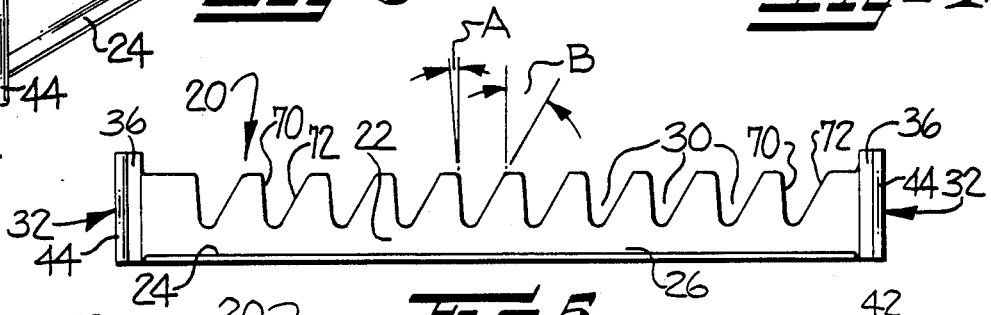
FIG. 5 is a side elevation view of the drawer divider shown in FIGS. 3 and 4.

As best shown in FIG. 5, the tool-holding recesses in the illustrated embodiment include front and rear faces 70, 72 respectively. Front face 70 is disposed at an angle A from vertical with rear face 72 at an angle B from vertical. In a preferred embodiment, angle A is approximately 5° and angle B is approximately 30°, thereby defining an included angle of approximately 35°. The relatively steep angle B permits tools to lean rearwardly and rest against rear face 72.

Referring to FIGS. 1 and 2, it can be seen that adjacent dividers 20 may be positioned within the drawer at an angle to the sidewalls such that the dividers diverge from one sidewall to the opposed sidewall and provide a means for holding shorter tools at one end, and longer tools at the other. Such positioning of the dividers is possible due to the resiliency of arms 34, 36 and the ability of the divider to pivot at or near juncture line 40. It has been found in practice that the dividers may be positioned at angles up to approximately 15 degrees from normal, such that with two adjacent dividers so positioned the dividers may form an included angle with respect to each other of up to approximately 30°. Insertion of dividers into drawers in the described manner provides a drawer system wherein the drawer may be subdivided into multiple rectangular or trapezoidal compartments of chosen shape and size.

While the present invention has been disclosed in connection with a particular embodiment, it will be appreciated that numerous modifications may be made without departing from the scope of the invention. For example, where the tool-holding function is not necessary or desirable, the drawer dividers may be formed without the tool-holding recesses. Furthermore, when desired, the drawer divider may be formed with sidewall engaging arms at only one end thereof, with the other end of the divider serving only to engage one of the opposed sidewalls. These and other modifications are within the true spirit and scope of the invention.

What is claimed is:

1. A drawer system characterized by being capable of subdivision into multiple rectangular or trapezoidal compartments of chosen shape and size, said system comprising:

a rectangular drawer having two opposed sidewalls that form the parallel sides of the mentioned compartments; and a plurality of integral, one-piece, removable drawer dividers formed of plastics material, each said drawer divider including a main body portion comprising a relatively thin elongate strip member having a length approximating the distance between the opposed sidewalls of a drawer, said body portion strip member being substantially vertically upstanding in the operational orientation of said drawer divider and including a plurality of upwardly facing recesses along the length thereof such that the recesses of adjacently positioned dividers may support articles therein, and each divider further including sidewall engaging portions integrally formed at both ends of said body portion, each sidewall engaging portion comprising a pair of resilient arms flaring outwardly from said body portion and terminating in sidewall-engaging tips formed with enlarged cross sectional configuration, said arms, in operational orientation, comprising substantially vertical members integrally joined together and integrally joined to their respective body portion ends at substantially vertical juncture lines, each pair of said arms collectively forming a V-shaped configuration, said arms being formed with sufficient resiliency and the integral juncture of the arms to the main body portion being so formed as to permit the divider, when inserted between the opposed drawer sidewalls, to resiliently engage the sidewalls at any selected positions therealong and at chosen angular orientation, thereby providing multiple rectangular or trapezoidal compartments of chosen shape and size.

2. A drawer system as claimed in or claim 1 wherein said divider main body portion includes means formed at the base thereof for lending lengthwise rigidity to the divider.

3. A drawer system as claimed in claim 2 wherein said means comprises a flange.

4. A drawer system as claimed in claim 1 wherein said recesses have an inverted sawtooth configuration.

5. A drawer system as claimed in claim 4 wherein each of the recesses of inverted sawtooth configuration is defined by a first upstanding surface approximately 5° off vertical and a second upstanding surface approximately 30° off vertical, defining an included angle of approximately 35°.

6. A drawer system as claimed in claim 1 including recesses formed adjacent said arm tips for facilitating the gripping action of the tips to the engaged sidewalls.

* * * * *